US011499352B2

(12) United States Patent
Guerin

(10) Patent No.: US 11,499,352 B2
(45) Date of Patent: Nov. 15, 2022

(54) FLUSH HANDLE CONTROL

(71) Applicant: U-Shin Italia S.p.A., Pianezza (IT)

(72) Inventor: Anthony Guerin, Pianezza (IT)

(73) Assignee: U-Shin Italia, S.pA., Pianezza (IT)

( * ) Notice: Subject to any disclaimer, the term of this patent is extended or adjusted under 35 U.S.C. 154(b) by 290 days.

(21) Appl. No.: 16/686,974

(22) Filed: Nov. 18, 2019

(65) Prior Publication Data

US 2020/0087956 A1 Mar. 19, 2020

Related U.S. Application Data

(63) Continuation of application No. PCT/EP2018/062656, filed on May 16, 2018.

(30) Foreign Application Priority Data

May 16, 2017 (EP) ..... 17171397

(51) Int. Cl.
*E05B 85/10* (2014.01)
*E05B 85/06* (2014.01)
*E05B 17/04* (2006.01)

(52) U.S. Cl.
CPC ..... *E05B 85/107* (2013.01); *E05B 85/06* (2013.01); *E05B 85/103* (2013.01); *E05B 17/042* (2013.01); *E05Y 2900/531* (2013.01)

(58) Field of Classification Search
CPC ..... E05B 85/107; E05B 85/06; E05B 85/103; E05B 85/10
See application file for complete search history.

(56) References Cited

U.S. PATENT DOCUMENTS 5,123,687 A * 6/1992 Pfeiffer ..... E05B 1/0092 292/DIG. 31
6,698,262 B2 * 3/2004 Wittwer ..... E05B 77/34 292/DIG. 31

(Continued)

FOREIGN PATENT DOCUMENTS

DE 4002963 7/1991
DE 102008019335 A1 * 10/2008 ..... E05B 85/107

(Continued)

OTHER PUBLICATIONS

"eccentric," Merriam-Webster.com Dictionary, https://www.merriam-webster.com/dictionary/eccentric. Accessed Oct. 25, 2021. (Year: 2021).*

(Continued)

*Primary Examiner* — Kristina R Fulton
*Assistant Examiner* — Emily G. Brown
(74) *Attorney, Agent, or Firm* — Burris Law, PLLC

(57) ABSTRACT

A control mechanism for controlling a door handle movable between a normal position in which the handle is flush with the door and a working position in which the handle protrudes from the door includes a first lever mounted so as to pivot about a first shaft supported by the handle, a second lever mounted so as to pivot about a second shaft supported by the handle in parallel to the first shaft and at a distance from the first shaft in a longitudinal direction of the handle, and a link rod having ends connected to the first lever and to the second lever by articulated links. At least one of the articulated links has play in a longitudinal direction of the link rod, and the first lever, the second lever, the link rod, and the handle form a deformable quadrilateral, the deformation of which moves of the handle.

12 Claims, 3 Drawing Sheets

(56) References Cited

U.S. PATENT DOCUMENTS

| | | | | |
|---|---|---|---|---|
| 10,174,528 | B2 * | 1/2019 | Velicanin | E05B 77/34 292/DIG. 31 |
| 10,927,573 | B2 * | 2/2021 | Och | E05B 85/103 |
| 2019/0234122 | A1 * | 8/2019 | Low | E05B 85/107 |
| 2019/0368239 | A1 * | 12/2019 | Rhein | E05B 85/103 |

FOREIGN PATENT DOCUMENTS

| | | | | |
|---|---|---|---|---|
| DE | 102014005797 | | 10/2015 | |
| DE | 202014010524 | | 2/2016 | |
| GB | 2477085 | | 7/2011 | |
| WO | 2008/129003 | | 10/2008 | |
| WO | 2015/043705 | | 4/2015 | |
| WO | 2015/074020 | | 5/2015 | |
| WO | WO-2016113341 | A1 * | 7/2016 | E05B 81/82 |
| WO | WO-2018137840 | A1 * | 8/2018 | E05B 85/107 |

OTHER PUBLICATIONS

International Search Report for International Application PCT/EP2018/062656, dated Jun. 12, 2018.

* cited by examiner

FLUSH HANDLE CONTROL

CROSS-REFERENCE TO RELATED APPLICATIONS

This application is a continuation of International Application No. PCT/EP2018/062656, filed on May 16, 2018, which claims priority to and the benefit of EP 17171397.7, filed on May 16, 2017. The disclosures of the above applications are incorporated herein by reference.

FIELD

The present disclosure relates to a mechanism for controlling a movable door handle between a rest position in which the handle is flush with the door and a working position in which the handle is projecting with respect to the door and is associated with a door latch by a door latch maneuvering member.

BACKGROUND

The statements in this section merely provide background information related to the present disclosure and may not constitute prior art.

There are known, in particular in the automotive field, doors equipped with flush handles. For the transition from the rest position to the working position, it is known to use either a pivoting control mechanism or a translational control mechanism.

Translational control mechanisms are renown for withstanding considerable exceptional loads, but while having a large bulk.

SUMMARY

The present disclosure provides a translational control mechanism having reduced bulk.

The present disclosure provides a mechanism for controlling a movable door handle between a rest position in which the handle is flush with the door and a working position in which the handle is projecting with respect to the door and is associated with a door latch by a door latch maneuvering member, the control mechanism comprising a case equipped with means for fastening to the door, the handle being mounted so as to slide within an opening of the door, in which the control mechanism comprises: a first lever mounted so as to pivot about a first axis carried by the handle; a second lever mounted so as to pivot about a second axis carried by the handle parallel to the first axis at a distance from the first axis according to a longitudinal direction of the handle; a tie rod having ends connected to the first lever and to the second lever according to hinged connections, at least one of which has a clearance according to a longitudinal direction of the tie rod, the first lever, the second lever, the tie rod and the handle forming a deformable quadrilateral folded for the rest position, and whose deployment causes a translational displacement of the handle.

Thus, in the rest position the mechanism occupies a small volume in the case, and the deployment of the mechanism is done towards the outside of the case so that even in the deployed position the mechanism occupies a small volume in the case.

According to an advantageous version of the present disclosure, the first lever includes a maneuvering arm which, when in the working position of the handle, is opposite a maneuvering element of the door latch maneuvering member, and said maneuvering arm bears on said door latch maneuvering element when a tension is exerted on the handle from the working position of the handle.

According to another advantageous aspect of the present disclosure, the mechanism comprises two tie rods disposed on either side of a midplane extending according to a longitudinal direction of the handle, and each having ends connected to the first lever and to the second lever according to hinged connections, at least one of which has a clearance according to a longitudinal direction of the tie rod. Thus, the forces transmitted by the tie rods are exerted in a balanced manner on both the first lever and the second lever so that the risk of jamming is reduced. In one form, the two tie rods are identical. The manufacturing series are therefore more considerable, which allows lowering the manufacturing cost of the mechanism.

According to other advantageous aspects of the present disclosure which may be implemented individually or in combination: The mechanism includes a member for deploying the handle from the rest position to the working position, disposed so as to bear on the first lever or the second lever; the deployment member comprises a cam eccentrically mounted on an axis of an electric motor; said first lever and said second lever have a Y-like general shape; the handle is hollow and at least one amongst said first lever and said second lever is cambered towards the inside of the handle; said deformable quadrilateral is configured so that the translation movement of the handle from the rest position to the working position is reversible; the mechanism includes a biasing member for elastically biasing the handle towards the rest position; said door latch is associated with a door latch lock, and said door latch lock includes a cylinder mounted obliquely in the case, and opening opposite an inner face of the handle; the mechanism comprises an inclination compensation member between said cylinder and a maneuvering member of said lock.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
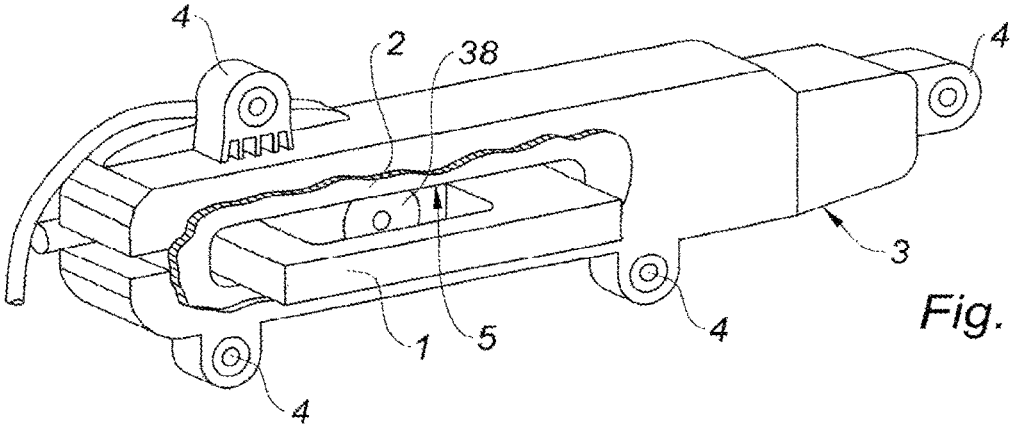
FIG. 1 is a schematic perspective view of the control mechanism of a door handle according to the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

With reference to the figures, the present disclosure concerns a mechanism for controlling the handle 1 of a door 2. The handle 1 is movable between a rest position in which the handle is flush with the door 2, and a working position in which the handle is projecting with respect to the door 2 as illustrated in FIG. 1. The control mechanism comprises a case 3 equipped with bosses 4 for fastening the case to the door 2. The handle 1 is mounted so as to slide within an opening 5 of the door 2.

As illustrated, the handle 1 is hollow. The mechanism for maneuvering the handle includes a first lever 6 having a Y-like general shape comprising a shank 7 cambered towards the inside of the handle and hingedly mounted on an axis 8 carried by the handle, and two branches 9 symmetrical with respect to a midplane extending according to a longitudinal direction of the handle, and each having an end connected according to a hinge 54 at one end of a tie rod 10 whose opposite end is hingedly connected to a second lever 11 by means of a hinge comprising an axis 12 carried by the second lever 11 and engaged in an oblong aperture 13 formed in the tie rod and extending according to the longitudinal direction of the tie rod. The axis 12 and the aperture 13 thus achieve for each tie rod a clearance according to a longitudinal direction of the tie rod.

At the end opposite to the hinge with the tie rod 10, the second lever 11 is hingedly mounted on an axis 14 carried by the handle. The axis 14 extends parallel to the axis 8, at a distance from it according to a longitudinal direction of the handle.

The first lever 6, the second lever 11 and the tie rod 10 thus achieve, together with the handle 1, a deformable quadrilateral whose deformation causes a translational displacement of the handle 1.

Figure 6:
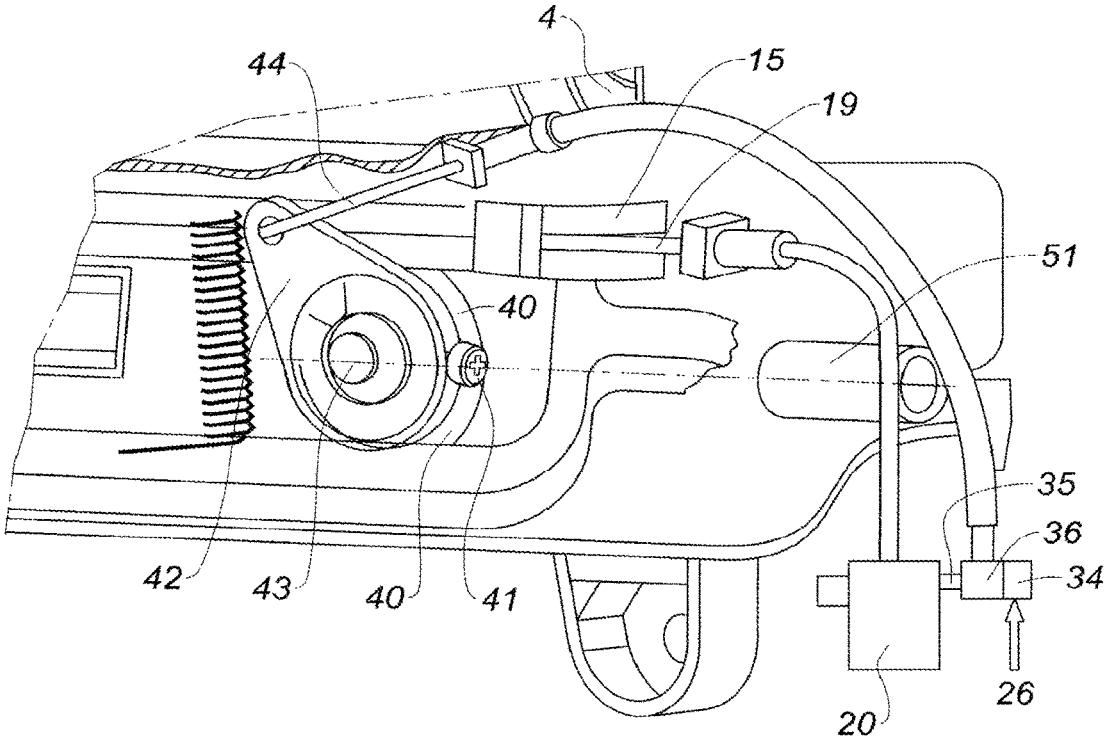
FIG. 6 is a schematic partial perspective view from inside the case.

Moreover, the mechanism comprises a door latch maneuvering member comprising a plate 15 mounted so as to pivot about an axis 16 carried by the case 3 and biased by a biasing member, such as a spring 17, towards a position in which an edge of the plate 15 bears against the inner face of the case 3. The plate 15 further includes a slot in which is engaged a head 18 of a cable 19 whose opposite end is connected to the door latch 20 (see FIG. 6). The rest position of the handle 1 corresponds a closure state of the latch 20.

The first lever 6 also includes a maneuvering arm 21, whose end extends opposite an edge of the plate 15. At the lower end of this edge, the plate 15 includes a maneuvering lug 22 whose function will be described hereinbelow.

Opposite one end of the lever 11 opposite to the pivot axis 14 of the second lever 11 with respect to the handle 1, the mechanism includes a deployment member 23, (also referred to herein as a cam 23) mounted eccentrically on an axis 24 carried by a motor 25 fastened in the case 3 and connected to a controller 26 adapted to receive deployment control signals from a remote control 27.

Moreover, the latch 20 includes a latch locking element made active when the handle is in the rest position.

Figure 2:
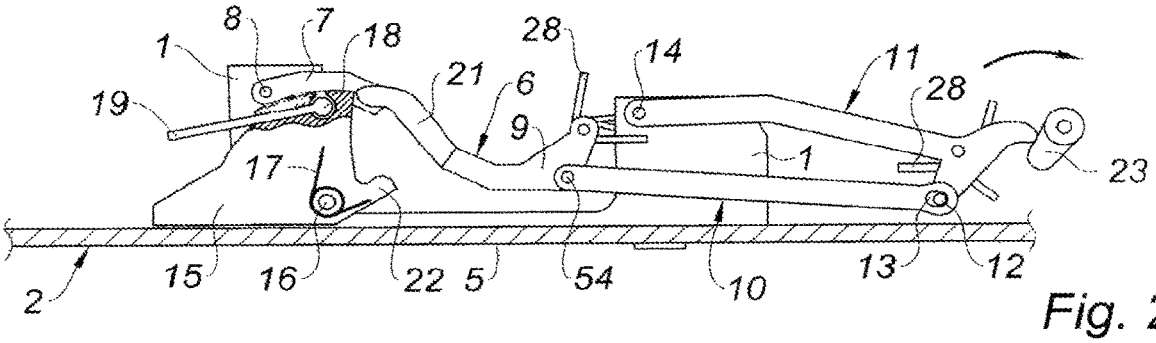
FIG. 2 is a schematic top view of the control mechanism represented without its case for a rest position of the handle.

The operation of the mechanism according to the present disclosure is as follows: springs 28 are suitably disposed between the levers and the case 3 so that, in association with the return spring 17, the bearing of the maneuvering arm 21 on the edge of the plate 15 and the end of the bearing of the second lever 11 on the deployment member 23, the assembly is held in a stable position for which the handle 1 is flush with the opening 5, as illustrated in FIG. 2.

Figure 3:
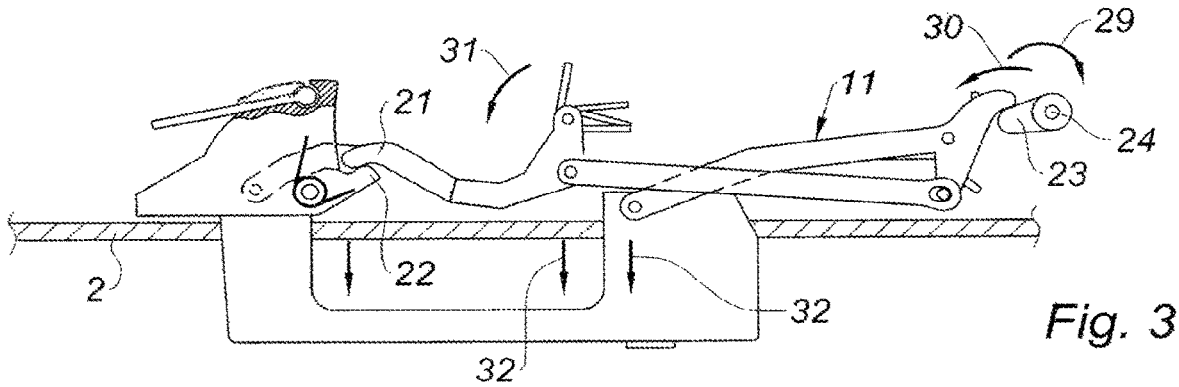
FIG. 3 is a view similar to that of FIG. 2 for a working position of the handle.
Figure 4:
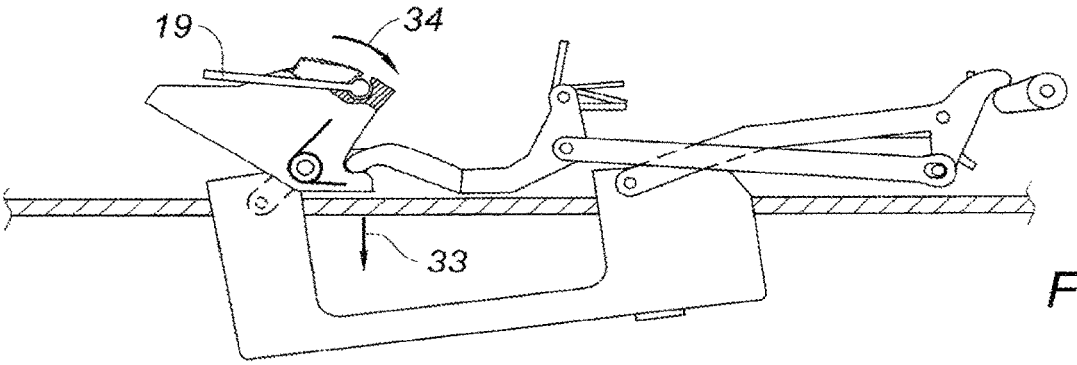
FIG. 4 is a view similar to that of FIG. 2 during an actuation of the handle in a direction for opening the door.
Figure 5:
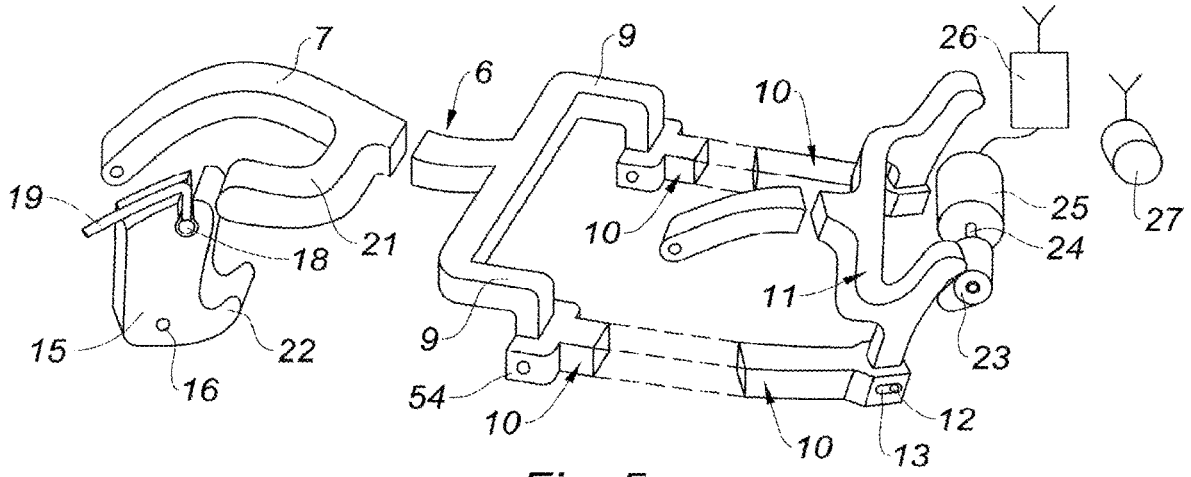
FIG. 5 is a schematic perspective view of a form of the first lever and the second lever.

When a deployment control signal is sent to the electric motor 25 by the controller 26, the deployment member 23 is driven in rotation as illustrated by the arrow 29 in FIG. 3 so that the levers 6 and 11 are tilted as indicated by the arrows 30 and 31 in FIG. 3. In this movement, the handle 1 is displaced in translation as indicated by the arrows 32, until the maneuvering arm 21 bears against the maneuvering lug 22. Simultaneously, an unlocking signal is sent to an electric unlocking member 34 associated with the latch 20. From this position, a tension performed on the handle as indicated by the arrow 33 in FIG. 4 makes the plate 15 tilt as indicated by the arrow 34 in FIG. 4 so that a tension is exerted on the cable 19 which opens the latch 20 of the door 2.

In the case where the electrical operation is defective, a manual bearing on the handle in line with the axis 14 causes a slight tilting of the lever 6, sufficient to engage the hand in the handle and exert a tension on it.

Simultaneously, it is desired to provide unlocking of the latch.

To this end, the mechanism according to the present disclosure comprises an unlocking device including a cylinder 37 carried by a support directly or indirectly fastened to the door 2, herein a ring 40 fastened in the case 3 and in which the cylinder 37 is held blocked by a screw 41 screwed into the ring 40 and whose end bears in a groove 39 of the cylinder 37. The screw 41 in one form is disposed so as to be accessible from the rabbet of the door 2, by passing a screwdriver in a tube 51 which opens into the rabbet of the door 2. The cylinder 37 includes an opening 38 for the introduction of a key 55. The cylinder 37 is connected to the unlocking element 35 of the latch via a maneuvering member 42, (also referred to herein as a lock lever 42) mounted so as to pivot on an axis 43 carried by the case 3 and connected to an unlocking member 36 by a cable 44.

Figure 7:
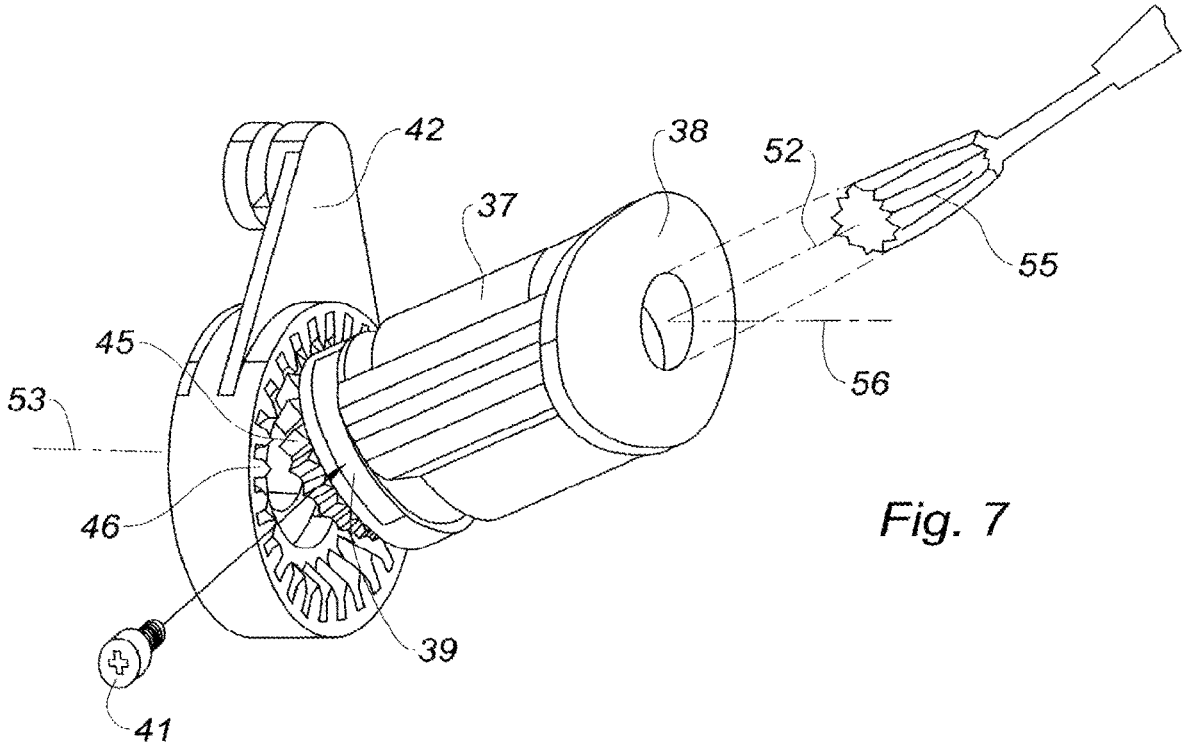
FIG. 7 is a perspective view of the unlocking device of the door latch according to a first form of the means for coupling the cylinder and the lock lever.

In the form shown in FIG. 7, the lock lever 42 is connected to the cylinder 37 by a coupling member comprising a male bevel gear 45 carried by the cylinder 37, and a female bevel gear 46 carried by the lock lever 42.

The coupling member thus has an input axis 52 and an output axis 53 which extend in two different directions. By an appropriate choice of the direction of the output axis 53, it is possible to adapt the coupling to the arrangement of the different elements contained in the case 3.

Figure 8:
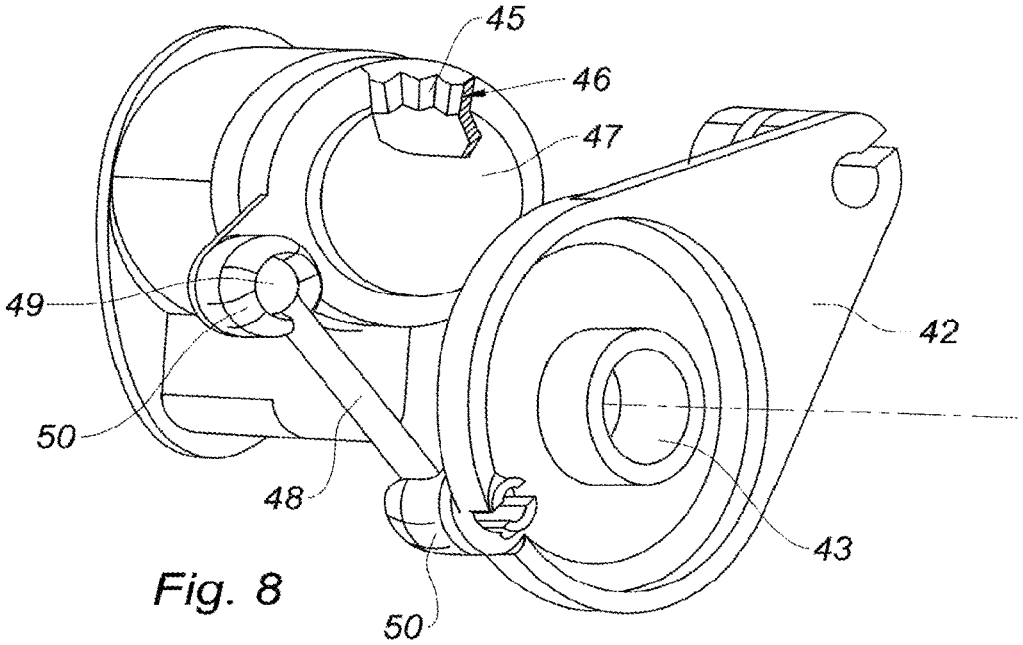
FIG. 8 is a schematic perspective view of a second form of the unlocking device.

In the form shown in FIG. 8, the female gear 46 is carried by a subplate 47 connected to the lock lever 42 by a dial mounting comprising a lever 48 carrying at each of its ends a ball joint 49 engaged in a ball joint support 50. Accordingly, a person of skill in the art would appreciate that the male bevel gear 45, female bevel gear 46, and the lever 48 can form a mechanism that can be referred to as an inclination compensation mechanism.

Of course, the present disclosure is not limited to the described forms and may be made according to variants that will appear to those skilled in the art without departing from the scope of the present disclosure as defined by the claims.

In particular, although the present disclosure has been described in connection with Y-shaped levers 6 and 11, each of the branches of a lever is connected to one of the corresponding branches of the other lever by tie rods disposed on either side of a midplane extending according to a longitudinal direction of the handle, the present disclosure can be made with levers connected by one single tie rod.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice; material, manufacturing, and assembly tolerances; and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A mechanism for controlling a door handle movable between a rest position in which the handle is flush with a door and a working position in which the handle is projecting with respect to the door and is associated with a door latch by a door latch maneuvering member, the control mechanism comprising a case equipped with fastening devices for fastening the case to the door, the handle being mounted so as to slide within an opening of the door, wherein the control mechanism comprises:

a first lever mounted so as to pivot about a first axis carried by the handle;

a second lever mounted so as to pivot about a second axis carried by the handle parallel to the first axis at a distance from the first axis according to a longitudinal direction of the handle; and at least one tie rod having ends respectively connected to the first lever and to the second lever according to hinged connections, at least one of said hinged connections has a clearance according to a longitudinal direction of the tie rod with which the at least one of said hinged connections is associated, the clearance being an oblong aperture formed in the tie rod, wherein the first lever, the second lever, the tie rod and the handle form a deformable quadrilateral whose deformation causes a translational displacement of the handle.

2. The mechanism according to claim 1, wherein the first lever includes a maneuvering arm which, when in the working position of the handle, is opposite a maneuvering element of the door latch maneuvering member, and in that said maneuvering arm bears on said door latch maneuvering element when a tension is exerted on the handle from the working position of the handle.

3. The mechanism according to claim 1, wherein the at least one tie rod includes two tie rods disposed on either side of a midplane extending according to a longitudinal direction of the handle, and each tie rod of the two tie rods having ends connected to the first lever and to the second lever according to hinged connections, at least one of the hinged connections of each tie rod of the two tie rods has a clearance according to a longitudinal direction of the tie rod with which the at least one of the hinged connections is associated.

4. The mechanism according to claim 3, wherein the two tie rods are identical.

5. The mechanism according to claim 1, further comprising a deployment member for deploying the handle from the rest position to the working position, wherein the deployment member is disposed so as to bear on the first lever or the second lever.

6. The mechanism according to claim 5, wherein the deployment member comprises a cam eccentrically mounted on an axis of an electric motor.

7. The mechanism according to claim 1, wherein said first lever and said second lever are Y-shaped levers.

8. The mechanism according to claim 1, wherein the handle is hollow and at least one of said first lever and said second lever is cambered towards the inside of the handle.

9. The mechanism according to claim 1, wherein said deformable quadrilateral is configured so that the translation movement of the handle from the rest position to the working position is reversible.

10. The mechanism according to claim 1, further comprising a biasing member for elastically biasing the handle towards the rest position.

11. The mechanism according to claim 1, wherein said door latch is associated with a door latch lock, and said door latch lock includes a cylinder obliquely mounted in the case, and opening opposite an inner face of the handle.

12. The mechanism according to claim 11, further comprising an inclination compensation mechanism between said cylinder and a maneuvering member of said door latch lock.

* * * * *